US009934774B1

(12) United States Patent
Lin et al.

(10) Patent No.: US 9,934,774 B1
(45) Date of Patent: Apr. 3, 2018

(54) NOISE-CANCELLING EARPHONE

(71) Applicant: Merry Electronics(Shenzhen) Co., Ltd., Guangdong (CN)

(72) Inventors: Chia-Chung Lin, Taichung (TW); Chih-Hung Wang, Taichung (TW)

(73) Assignee: Merry Electronics(Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/375,166

(22) Filed: Dec. 12, 2016

(30) Foreign Application Priority Data

Sep. 30, 2016 (TW) ..... 105131459 A

(51) Int. Cl.

| | |
|---|---|
| ***G10K 11/16*** | (2006.01) |
| ***G10K 11/178*** | (2006.01) |
| ***H04R 1/10*** | (2006.01) |
| *H04R 1/20* | (2006.01) |
| *H04R 25/00* | (2006.01) |

(52) U.S. Cl.
CPC ..... *G10K 11/1786* (2013.01); *H04R 1/1016* (2013.01); *H04R 1/1075* (2013.01); *G10K 2210/1081* (2013.01); *G10K 2210/3044* (2013.01); *H04R 2460/01* (2013.01)

(58) Field of Classification Search
CPC ..... H04R 1/1016; H04R 1/1083; H04R 2460/01; H04R 25/656; H04R 1/1066; H04R 25/652; H04R 5/033; H04R 2400/01; H04R 2410/05; H04R 2460/11; H04R 3/00; H04R 3/005; G10K 2210/1081; G10K 11/1784; G10K 2210/108; G10K 2210/3045; G10K 2210/3226
USPC ..... 381/380, 71.6, 322, 370, 150, 328, 338, 381/373, 382, 74
See application file for complete search history.

(56) References Cited

U.S. PATENT DOCUMENTS

| | | | | |
|---|---|---|---|---|
| 8,385,560 | B2 | 2/2013 | Solbeck et al. | |
| 2004/0240695 | A1* | 12/2004 | Leedom | A61B 5/6817 381/328 |
| 2006/0067555 | A1* | 3/2006 | Tsai | H04R 1/1016 381/380 |

(Continued)

FOREIGN PATENT DOCUMENTS

| | | |
|---|---|---|
| CN | 103460714 | 12/2013 |
| CN | 104394490 | 3/2015 |

(Continued)

OTHER PUBLICATIONS

"Office Action of Taiwan Counterpart Application," dated Aug. 23, 2017, p. 1-p. 5.

*Primary Examiner* — Norman Yu
(74) *Attorney, Agent, or Firm* — JCIPRNET

(57) ABSTRACT

A noise-cancelling earphone including a housing, an eartip, a speaker, a first microphone and a second microphone is provided. The housing includes a tube and a chamber. The tube has a first end and a second end opposite to the first end. The first end of the tube has an audio outlet, and the chamber is connected to the second end of the tube. The eartip is sleeved on the tube, and the eartip has an accommodating space which accommodates the tube. The speaker and the first microphone are disposed inside the tube and located in the accommodating space of the eartip. The second microphone is disposed inside the chamber.

19 Claims, 5 Drawing Sheets

(56) References Cited

U.S. PATENT DOCUMENTS

| | | | | |
|---|---|---|---|---|
| 2007/0189570 | A1* | 8/2007 | Matsuo | H04R 1/1016 381/382 |
| 2009/0080670 | A1* | 3/2009 | Solbeck | H04R 25/453 381/71.6 |
| 2016/0293156 | A1* | 10/2016 | Yang | G10K 11/1784 |

FOREIGN PATENT DOCUMENTS

| | | |
|---|---|---|
| CN | 204291302 | 4/2015 |
| TW | M283470 | 12/2005 |
| TW | I376164 | 11/2012 |
| WO | 2015164287 | 10/2015 |

* cited by examiner

NOISE-CANCELLING EARPHONE

CROSS-REFERENCE TO RELATED APPLICATION

This application claims the priority benefit of Taiwan application serial no. 105131459, filed on Sep. 30, 2016. The entirety of the above-mentioned patent application is hereby incorporated by reference herein and made a part of this specification.

BACKGROUND OF THE INVENTION

Field of the Invention

The invention relates to an earphone and more particularly relates to a noise-cancelling earphone.

Description of Related Art

With continuous advancement in technology, electronic products all develop towards a trend of lightweight miniaturization. People can use miniaturized electronic products at anytime and anywhere, such as radios, portable audio players, or smartphones, etc. Regardless of the types of electronic product above, to enable a user to listen to sound information provided by the electronic products in a condition without disturbing others, earphones have become a necessary accessory for electronic products.

When wearing ordinary earphones, noise can easily leak through a gap between an eartip and an ear canal, causing interference to the user. In current existing technology, noise-cancelling earphones include active noise-cancelling earphones and passive noise-cancelling earphones. Passive noise-cancelling earphones mostly adopt mechanical noise reduction approach, but noise-cancelling effects thereof are not good. Active noise-cancelling earphones adopt active sound reduction principles to perform noise reduction, by using a microphone to receive outside noise and, with an electronic circuit, producing a signal of inverted phase to the noise sound wave. Once produced, this anti-phase signal destructively interferes to cancel the outside noise that originally would have been heard by the earphone wearer, thereby achieving the purpose of noise cancellation. Generally, active noise-cancelling earphones having relatively large volume and weight are mainly headset-based earphones and have inconvenient portability. Therefore, improvement in the structure of noise-cancelling earphones is a topic that developers must face.

SUMMARY OF THE INVENTION

The invention provides a noise-cancelling earphone, which effectively cancels noise and may also achieve a demand for miniaturization of the earphone.

The noise-cancelling earphone of the invention includes a housing, an eartip, a speaker, a first microphone and a second microphone. The housing includes a tube and a chamber. The tube has a first end and a second end opposite to the first end. The first end of the tube has an audio outlet, and the chamber is connected to the second end of the tube. The eartip is sleeved on the tube, and the eartip has an accommodating space which accommodates the tube. The speaker and the first microphone are disposed inside the tube and located in the accommodating space of the eartip. The second microphone is disposed inside the chamber.

The noise-cancelling earphone of the invention includes a housing, an eartip, a speaker, a first microphone and a second microphone. The housing includes a tube and a chamber. The tube has a first end and a second end opposite to the first end. The first end of the tube has an audio outlet, and the chamber is connected to the second end of the tube, wherein a tube internal diameter of the tube is between 3.2 mm to 4.3 mm. The eartip is sleeved on the tube. The speaker and the first microphone are disposed inside the tube. The second microphone is disposed inside the chamber.

Accordingly, in the noise-cancelling earphone of the invention, through such manner of configuration, noise may be collected more comprehensively, and the demand for miniaturization of the earphone may also be achieved.

To make the above and other features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
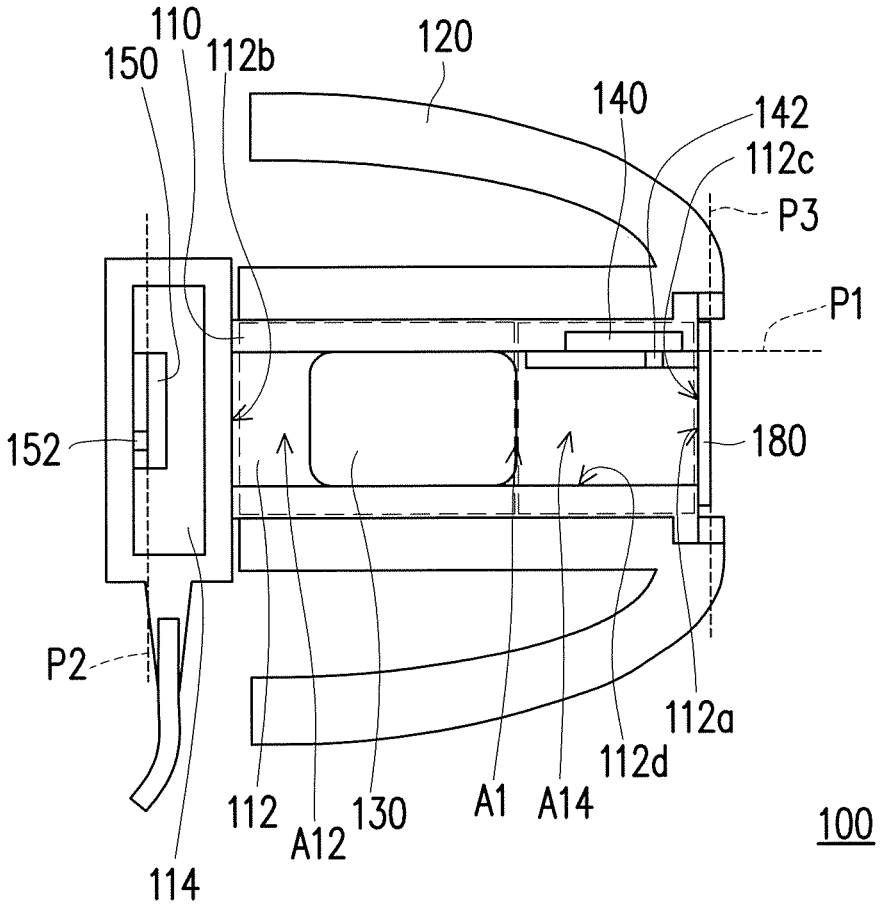
FIG. 1 is a schematic diagram of a noise-cancelling earphone according to an embodiment of the invention.
Figure 2A:
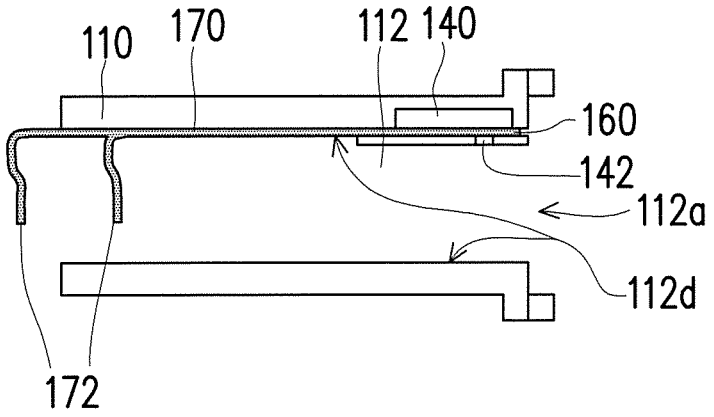
FIGS. 2A to 2F are schematic diagrams of steps of a circuit assembly of a noise-cancelling earphone according to an embodiment of the invention.
Figure 2B:
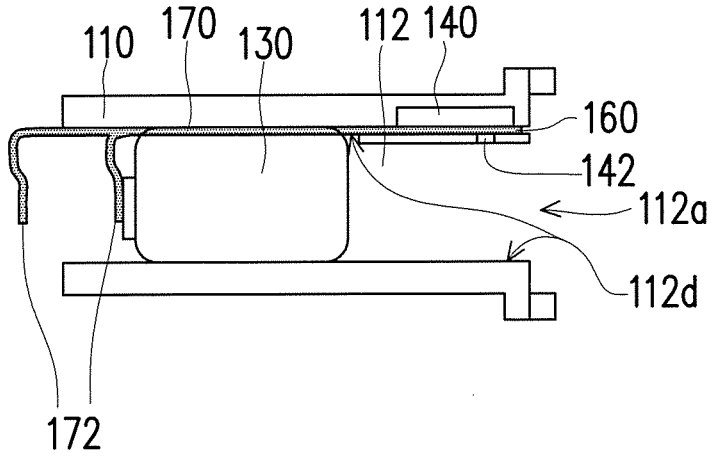
Figure 2C:
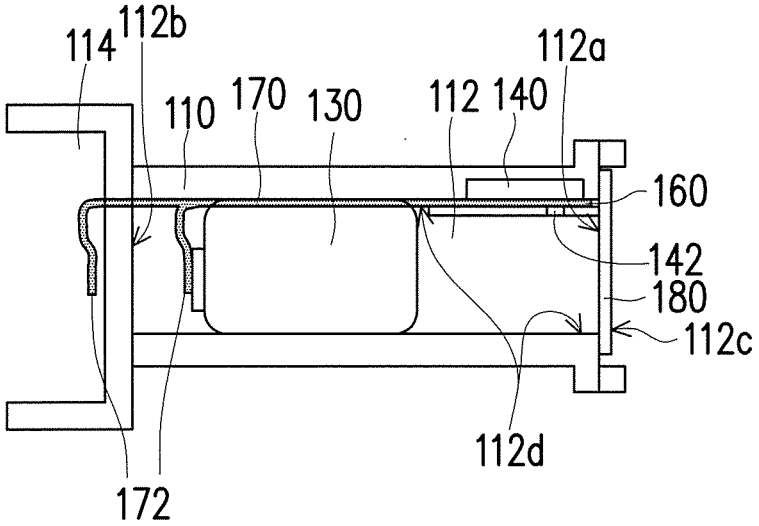
Figure 2D:
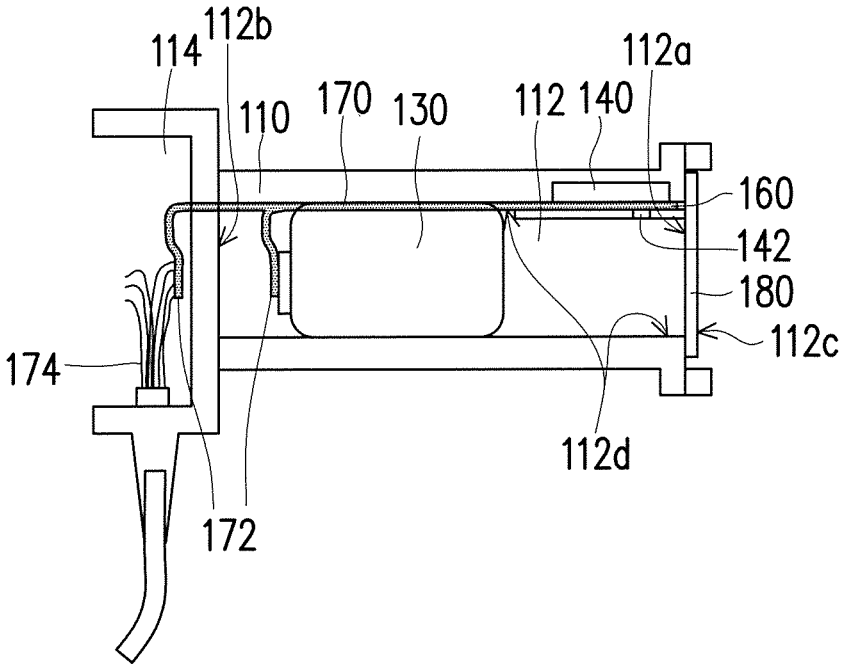
Figure 2E:
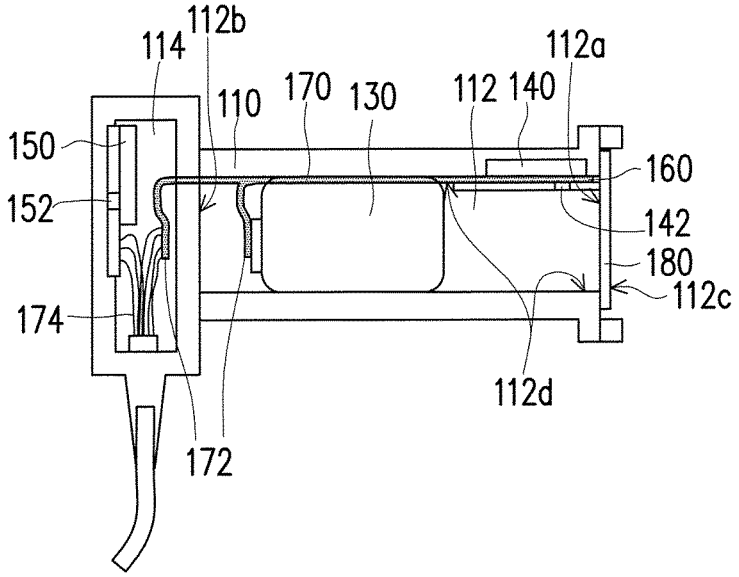
Figure 2F:
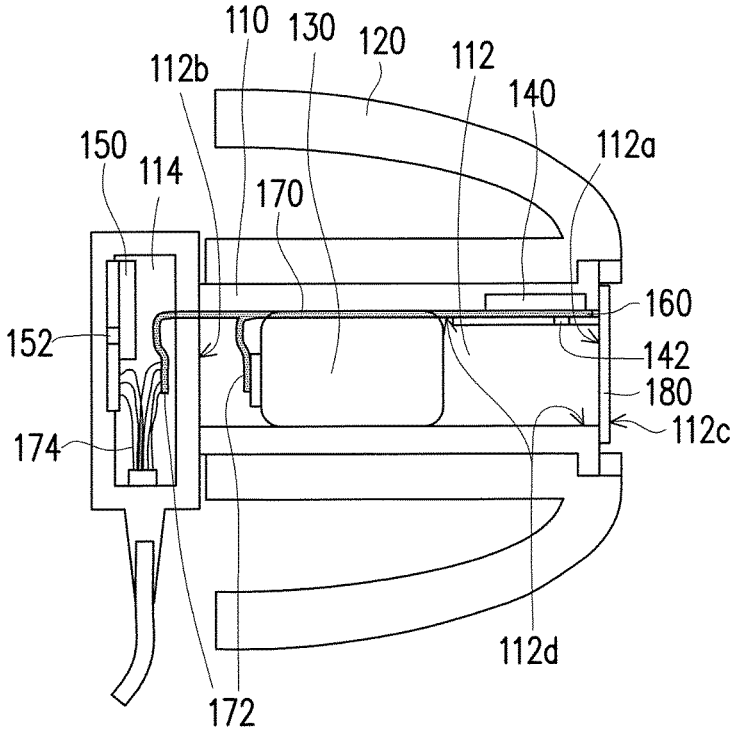

FIG. 1 is a schematic diagram of a noise-cancelling earphone according to an embodiment of the invention. Referring to FIG. 1, the noise-cancelling earphone 100 of the embodiment includes a housing 110, an eartip 120, a speaker 130, a first microphone 140 and a second microphone 150. The housing 110 includes a tube 112 and a chamber 114. The housing 110 is, for example, integrally formed as one piece, or can be a multi-piece member composition, but the invention is not limited thereto. The tube 112 has a first end 112*a* and a second end 112*b* opposite to the first end 112*a*. The first end 112*a* of the tube 112 has an audio outlet 112*c*, and the chamber 114 is connected to the second end 112*b* of the tube 112. The eartip 120 is sleeved on the tube 112, and the eartip 120 has an accommodating space A1 which accommodates the tube 112.

In the embodiment, the speaker 130 and the first microphone 140 are disposed inside the tube 112 and located in the accommodating space A1 of the eartip 120. The speaker 130 is located near the second end 112*b* of the tube 112, whereas the first microphone 140 is located near the first end 112*a* of the tube 112. More specifically, the speaker 130 is located in a first region A12, and the first microphone 140 is located in a second region A14. In addition, the first region A12 and the second region A14 do not overlap each other. The staggered manner of configuration of the speaker 130 and the first microphone 140 enables the accommodating space A1 to accommodate the speaker 130 of a larger size, thereby allowing a user to obtain better low-frequency response, and enhancing the level of noise reduction of the noise-cancelling earphone 100 at low frequency.

The second microphone 150 is disposed inside the chamber 114. The first microphone 140 is disposed adjacent to the first end 112*a* of the tube 112. The speaker 130 is located on a tube wall 112*d* of the tube 112. Materials of the eartip 120 are materials, such as soft rubber, plastic or foam, etc., that can suitably elastically deform according to the contour of an ear canal of the user, such that the eartip 120 can be closely fitted to the ear canal of the user and may isolate environmental noise, thereby producing passive noise-cancelling effects and enhancing sound fidelity.

In the embodiment, a first plane P1, where the first microphone 140 is located, is perpendicular to a third plane P3, where the audio outlet 112*c* is located, and a second plane P2, where the second microphone 150 is located, is parallel to the third plane P3, where the audio outlet 112*c* is located. Furthermore, the first plane P1, where the first microphone 140 is located, is perpendicular to the second plane P2, where the second microphone 150 is located, and the second plane P2, where the second microphone 150 is located, is parallel to the third plane P3, where the audio outlet 112*c* is located. In addition, the first microphone 140 is located between the speaker 130 and the audio outlet 112*c* of the tube 112. For example, the first microphone 140 can be a feedback microphone, and the second microphone 150 can be a feedforward microphone.

More specifically, an audio inlet 142 of the first microphone 140 is facing towards the tube wall 112*d* of the tube 112, and an audio inlet 152 of the second microphone 150 is facing towards the outside. In other words, the first microphone 140 and the second microphone 150 respectively collect noise from different directions. The first microphone 140 is horizontally installed (namely, installed substantially parallel to an extending direction of the tube 112), and the second microphone 150 is vertically installed (namely, installed substantially perpendicular to the extending direction of the tube 112). Through such manner of configuration, the scope of noise reduction may be broadened, so that the noise-cancelling effects are more comprehensive, and by means of a control circuit (not illustrated) and the speaker 130, a sound wave with inverted phase and same amplitude as the collected noise is produced to perform interference cancellation, thereby achieving better noise-cancelling effects.

FIGS. 2A to 2F are schematic diagrams of steps of a circuit assembly of a noise-cancelling earphone according to an embodiment of the invention. Referring to FIG. 1 and FIGS. 2A to 2F, in the embodiment, the noise-cancelling earphone 100 further includes a circuit carrier 160 and a flexible circuit substrate 170. The circuit carrier 160 is disposed inside the tube 112 to carry the first microphone 140. The flexible circuit substrate 170 is electrically connected to the first microphone 140, the circuit carrier 160 and the speaker 130. Furthermore, the flexible circuit substrate 170 also includes pins 172, wherein the pins 172 are respectively electrically connected to the speaker 130 and signal wires 174. Since a noise-cancelling circuit is disposed on the circuit substrate, the first microphone 140 and the second microphone 150 may collect a noise signal and then produce an anti-phase noise-cancelling signal through the circuit carrier 160 and the flexible circuit substrate 170, and emit a sound wave with inverted phase and same amplitude as the noise through the speaker 130. The sound wave destructively interferes to cancel the noise in the ear canal and outside; thereby the purpose of noise cancellation may be achieved.

For example, when assembling the noise-cancelling earphone 100, firstly, the circuit carrier 160 carrying the first microphone 140 and the flexible circuit substrate 170 electrically connected to the circuit carrier 160 are placed inside the housing 110, wherein a plane, where the circuit carrier 160 is located, is parallel to a plane, where the first microphone 140 is located. In other words, the circuit carrier 160 and the first microphone 140 are horizontally disposed, whereas the flexible circuit substrate 170 is placed along the tube wall 112*d* of the tube 112. At the same time, the first microphone 140 is placed at the first end 112*a* of the tube 112, and the audio inlet 142 is facing towards the tube wall 112*d*.

Secondly, the speaker 130 is placed inside the tube 112, so that the speaker 130 is electrically connected to one of the pins 172. It should be noted that the speaker 130 and the first microphone 140 do not overlap each other. Next, a mesh 180 is placed at the audio outlet 112*c*, so as to prevent foreign body from entering inside the tube 112. At the same time, a partition board of the chamber 114 and the tube 112 are connected together, so that the chamber 114 and the tube 112 are isolated.

Next, the signal wires 174 are placed in the chamber 114 and electrically connected to another of the pins 172. In addition, the second microphone 150 is placed inside the chamber 114, vertically disposed, and electrically connected to the signal wires 174, and at the same time, the audio inlet 152 of the second microphone 150 is facing towards the outside, so as to collect outside noise. Accordingly, a plane, where the audio inlet 142 of the first microphone 140 is located, and a plane, where the audio inlet 152 of the second microphone 150 is located, are mutually perpendicular. Finally, the eartip 120 is sleeved on the tube 112, completing the assembly of the noise-cancelling earphone 100.

More specifically, a rigid-flex composite circuit substrate formed by combining the circuit carrier 160 with the flexible circuit substrate 170 possess both flexibility of a flexible circuit substrate and rigidity of a rigid circuit substrate. Under the circumstances of internal space of electronic products being rapidly compressed, such rigid-flex composite circuit substrate provides maximum flexibility for member connection and assembly space and simplifies the degree of complexity in assembling the noise-cancelling earphone.

Figure 3:
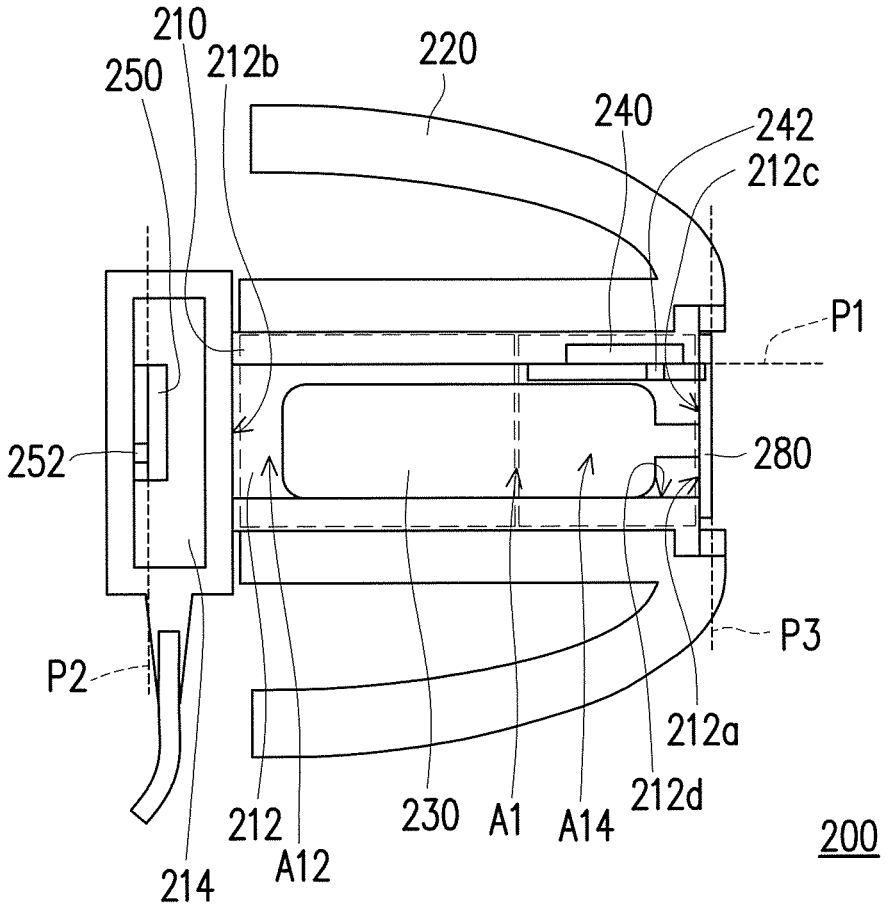
FIG. 3 is a schematic diagram of a noise-cancelling earphone according to another embodiment of the invention.

FIG. 3 is a schematic diagram of a noise-cancelling earphone according to another embodiment of the invention. Referring to FIG. 1 and FIG. 3, wherein the same or similar elements adopt the same or similar reference numerals and are not described again. It should be noted that a noise-cancelling earphone 200 of this embodiment is generally similar to the noise-cancelling earphone 100 of FIG. 1. Thus, this embodiment adopts partial content of the above embodiments, and descriptions of the same technical content are omitted. Regarding descriptions of the omitted portions, the above embodiments can be referred, and the descriptions are not repeated in the following embodiments. The main differences between the noise-cancelling earphone 200 of this embodiment and the noise-cancelling earphone 100 of FIG. 1 lie in, for example, that an audio inlet 242 of a first microphone 240 is facing towards a speaker 230, and the audio inlet 242 is adjacent to a first end 212*a* of a tube 212. In other words, in this embodiment, the first microphone 240 is located in the second region A14, and the speaker 230 is located in the first region A12 and extends to the second region A14. That is, the speaker 230 and the first microphone 240 are simultaneously present in the second region A14. Through such manner of configuration, the size of the tube 212 may be reduced, thereby achieving a demand for miniaturization of the noise-cancelling earphone.

Furthermore, in this embodiment, since the speaker 230 is close to an audio outlet 212*c*, a user is allowed to obtain the better high-frequency response. In addition, since the speaker 230 is even closer to the user's eardrum, a phase difference produced due to a distance present between the speaker 230 and the user's eardrum may be reduced, thereby achieving better noise-cancelling effects.

In an embodiment, a tube internal diameter 212 of the noise-cancelling earphone 200 is, for example, between 3.2 mm to 4.3 mm, thereby achieving a demand for miniaturization of the noise-cancelling earphone.

In summary of the above, through the manner of configuration of the first microphone and the second microphone respectively facing towards different directions to respectively collect noise from different directions, the noise-cancelling earphone of the invention may effectively enhance sensitivity and accuracy of noise sampling, so as to perform noise reduction, allowing the user to be able to obtain the better music entertainment enjoyment. Furthermore, the noise-cancelling earphone of the invention has simple and concise component structure and may achieve a demand for miniaturization.

Although the present invention has been described with reference to the above embodiments, it will be apparent to those skilled in the art that various modifications and variations can be made to the disclosed embodiments without departing from the scope or spirit of the invention. In view of the foregoing, it is intended that the invention covers modifications and variations provided that they fall within the scope of the following claims and their equivalents.

What is claimed is:

1. A noise-cancelling earphone, comprising:

a housing, comprising a tube and a chamber, the tube having a first end and a second end opposite to the first end, the first end of the tube having an audio outlet, and the chamber being connected to the second end of the tube;

an eartip, sleeved on the tube, and the eartip having an accommodating space accommodating the tube;

a speaker;

a first microphone, wherein the speaker and the first microphone are entirely disposed inside the tube and located in the accommodating space of the eartip;

a second microphone, disposed inside the chamber; and a conductive structure, integrated the speaker and the first microphone, wherein the conductive structure is placed along a tube wall of the tube and positioned into an ear canal of a wearer.

2. The noise-cancelling earphone according to claim 1, wherein a first plane, where the first microphone is located, is perpendicular to a third plane, where the audio outlet is located, and a second plane, where the second microphone is located, is parallel to the third plane, where the audio outlet is located.

3. The noise-cancelling earphone according to claim 1, wherein a first plane, where the first microphone is located, is perpendicular to a second plane, where the second microphone is located.

4. The noise-cancelling earphone according to claim 1, wherein a second plane, where the second microphone is located, is parallel to a third plane, where the audio outlet is located.

5. The noise-cancelling earphone according to claim 1, wherein the first microphone is disposed adjacent to the first end of the tube.

6. The noise-cancelling earphone according to claim 1, wherein the speaker is located on a tube wall of the tube.

7. The noise-cancelling earphone according to claim 6, wherein the first microphone is located between the speaker and the audio outlet of the tube.

8. The noise-cancelling earphone according to claim 6, wherein an audio inlet of the first microphone is facing towards the speaker, and the audio inlet is adjacent to the first end of the tube.

9. The noise-cancelling earphone according to claim 1, wherein the conductive structure comprising:

a circuit carrier, disposed inside the tube and carrying the first microphone into the ear canal of the wearer.

10. A noise-cancelling earphone, comprising:

a housing, comprising a tube and a chamber, the tube having a first end and a second end opposite to the first end, the first end of the tube having an audio outlet, and the chamber being connected to the second end of the tube, wherein a tube internal diameter of the tube is between 3.2 mm to 4.3 mm;

an eartip, sleeved on the tube;

a speaker;

a first microphone, wherein the speaker and the first microphone are entirely disposed inside the tube;

a second microphone, disposed inside the chamber; and a conductive structure, integrated the speaker and the first microphone, wherein the conductive structure is placed along a tube wall of the tube and positioned into an ear canal of a wearer.

11. The noise-cancelling earphone according to claim 10, wherein the eartip has an accommodating space accommodating the tube, and the first microphone is located in the accommodating space of the eartip.

12. The noise-cancelling earphone according to claim 10, wherein a first plane, where the first microphone is located, is perpendicular to a third plane, where the audio outlet is located, and a second plane, where the second microphone is located, is parallel to the third plane, where the audio outlet is located.

13. The noise-cancelling earphone according to claim 10, wherein a first plane, where the first microphone is located, is perpendicular to a second plane, where the second microphone is located.

14. The noise-cancelling earphone according to claim 10, wherein a second plane, where the second microphone is located, is parallel to a third plane, where the audio outlet is located.

15. The noise-cancelling earphone according to claim 10, wherein the first microphone is disposed adjacent to the first end of the tube.

16. The noise-cancelling earphone according to claim 10, wherein the speaker is located on a tube wall of the tube.

17. The noise-cancelling earphone according to claim 16, wherein the first microphone is located between the speaker and the audio outlet of the tube.

18. The noise-cancelling earphone according to claim 16, wherein an audio inlet of the first microphone is facing towards the speaker, and the audio inlet is adjacent to the first end of the tube.

19. The noise-cancelling earphone according to claim 10, wherein the conductive structure comprising:

a circuit carrier, disposed inside the tube and carrying the first microphone into the ear canal of the wearer.

* * * * *